US005692992A

United States Patent [19]

Arvidsson et al.

[11] Patent Number: 5,692,992

[45] Date of Patent: Dec. 2, 1997

[54] SHIFT ASSIST AND ENGINE INTERRUPTER APPARATUS

[75] Inventors: Lennart Arvidsson, Virginia Beach; Jan Grundberg, Chesapeake, both of Va.

[73] Assignee: Volva Penta of the Americas, Inc., Chesapeake, Va.

[21] Appl. No.: 602,570

[22] Filed: Feb. 14, 1996

[51] Int. Cl.[6] ..... F16H 59/74

[52] U.S. Cl. ..... 477/101; 477/103; 477/107; 477/181; 74/470; 192/30 W

[58] Field of Search ..... 74/470; 192/30 W; 477/101, 103, 107, 177, 181

[56] References Cited

U.S. PATENT DOCUMENTS

| | | | |
|---|---|---|---|
| Re. 32,998 | 7/1989 | Davis . | |
| 4,027,555 | 6/1977 | Rauchle et al. | 477/107 X |
| 4,262,622 | 4/1981 | Dretzka et al. . | |
| 4,432,734 | 2/1984 | Bland et al. . | |
| 4,488,455 | 12/1984 | Shetler et al. | 477/101 X |
| 4,525,149 | 6/1985 | Broughton et al. | 477/103 X |
| 4,753,618 | 6/1988 | Entringer . | |
| 4,843,914 | 7/1989 | Koike . | |
| 4,973,274 | 11/1990 | Hirukawa | 477/101 X |
| 4,976,636 | 12/1990 | Torigai et al. . | |
| 5,072,629 | 12/1991 | Hirukawa et al. . | |

FOREIGN PATENT DOCUMENTS

| | | | |
|---|---|---|---|
| 136415 | 7/1979 | Germany | 192/30 W |
| 3-172675 | 7/1991 | Japan | 74/470 |

OTHER PUBLICATIONS

OMC Manual, pp. 8–27—8–32.

Merc Manual, General Information pp. 1C–15—1C–23.

*Primary Examiner*—Rodney H. Bonck
*Assistant Examiner*—Nathan O. Jensen
*Attorney, Agent, or Firm*—Howrey & Simon; Richard H. Kjeldgaard

[57] ABSTRACT

A shift assist apparatus for a marine drive includes a tube having a pair of biased springs, between which a sleeve at the end of a transmission cable is movably retained. A remote control cable is fixedly attached to the tube. High transmission cable shift forces associated with resistance to shifting cause the sleeve to move against the bias of one of the springs. A sensor detects this movement and sends an electrical signal to interrupt the engine ignition circuit, thereby preventing the firing of one or more cylinders of the engine. The interruption of the engine ignition reduces the torque on the shift mechanism, in turn reducing the shift forces in the transmission cable and enabling the operator to shift the transmission. When the shift operation is completed, the engine resumes normal firing.

14 Claims, 2 Drawing Sheets

SHIFT ASSIST AND ENGINE INTERRUPTER APPARATUS

BACKGROUND OF THE INVENTION

The present invention relates broadly to marine drives, and particularly to marine drives having a reversing transmission, such as outboard motors and inboard-outboard drives. More particularly, the invention relates to an improved shifting mechanism for a reversing transmission, high-torque marine drive.

Many marine drives, such as inboard transmissions, outboard motors and stern drives, utilize reversing clutches or transmissions which connect the output shaft of an engine to the propeller shaft to provide forward drive, reverse drive, and neutral operation. Such transmissions often include a driving gear on the engine output shaft, meshing with a pair of opposed, axially spaced drive gears. A clutch, such as a cone clutch or a clutch dog, operatively connected to the propeller shaft is also typically provided, which can be selectively shifted into engagement with the driven gears.

High shift load forces, causing resistance to shifting, can be experienced in high-torque marine drives when the operator attempts to shift the transmission of the marine drive from forward or reverse drive to neutral. The torque exerted by the engaged drive gear on the clutch creates a resistance to axial movement of the clutch from a drive gear to neutral. Such torque can be reduced, and shifting facilitated, by temporarily interrupting engine ignition for one or more cylinders of the engine. Devices used to reduce the torque forces and aid shifting are hereinafter referred to generally as shift assist devices or shift interrupters.

The following United States Patents relate to mechanisms used to reduce shift force loads by engine ignition interruption.

| PATENTEE | U.S. Pat. No. | ISSUE DATE |
|---|---|---|
| Dretzka et al. | 4,262,622 | April 21, 1981 |
| Bland et al. | 4,432,734 | February 21, 1984 |
| Broughton et al. | 4,525,149 | June 15, 1985 |
| Entringer | 4,753,618 | June 28, 1988 |
| Hirukawa | 4,973,274 | November 27, 1990 |
| Hirukawa et al. | 5,072,629 | December 17, 1991 |

Substantially all of the mechanisms have reduced shift forces by some variation of a "shift lever" mechanism, in which a remote control cable and a transmission cable are connected to a shift level This is frequently accomplished by a switch actuated by the relative motion of a member attached to the lever, as is true of Dretzka et al., Bland et at., Broughton et al., and Entringer. In the case of Hirukawa and Hirukawa et al., a piezoelectric signal is generated by an elastic sandwich arrangement in a joint on the lever. The devices activate an engine ignition interrupt circuit, and engine ignition is temporarily disabled.

In the foregoing devices, a large number of parts typically must be fabricated and attached to the engine structure, or to a structure on the marine craft such as the transom, to accomplish the desired purpose. Accordingly, it is an object of the invention to provide a shift assist mechanism with fewer parts and a coordinate reduction in the cost and labor required to manufacture and service the marine drive unit.

The foregoing devices typically do not perform the shift assist function by a structure allowing the remote control and transmission cables to function coaxially. A further object of the invention is to provide a shift assist device in which the remote control and transmission cables can operate coaxially.

Presently used devices involve many moving parts associated with the operation of a lever by shift cables. It is a further object of this invention to provide a shift assist mechanism with fewer moving parts and a simpler mode of operation. By reducing the number of moving parts, the wear and service adjustment characteristics of the present device are improved. The many moving parts of presently used devices lead to relatively rapid wear and tear of the shift level arrangement.

In addition, the points at which the remote control and transmission cables are attached to the lever can potentially add undesired play into the cable system. Accordingly, a further object of the invention is to provide a shift interrupter which adds little play to the cable system.

SUMMARY OF THE INVENTION

The invention provides an apparatus for assisting shifting in a transmission for marine drive units. The shift assist apparatus of the present invention provides a device which operates conventionally unless and until shift resistance forces, such as are commonly associated with high torque engine operation, exceed a predetermined level.

The invention provides a shift assist device for assisting the shifting of a clutch of a marine drive or gear box by reducing the speed of the marine drive or gear box. The device provides a first cable, operatively connected to an operator station, with an end remote from the operator station. A second cable is also provided, coaxial with the first cable. The second cable is operatively connected to a clutch mechanism, has an end remote from the clutch mechanism, and is capable of movement in common with, and relative to, the end of the first cable. A biasing means, responsive to forces exceeding a threshold level, is provided for maintaining the end of the second cable in operative contact with the end of the first cable. Finally, the invention provides means for interrupting engine ignition in response to coaxial movement of the end of the second cable with respect to the end of the first cable.

The invention also provides a shift assist device for assisting the shifting of a clutch of a marine drive or gear box by reducing the speed of said marine drive or gear box. The device provides a first cable operatively connected to an operator station, with an end remote from the operator station. A second cable is also provided. The second cable is operatively connected to a clutch mechanism, has an end remote from the clutch mechanism. A spring is provided, responsive to forces exceeding a threshold level and maintaining the end of the second cable in operative contact with the end of the first cable. Finally, engine ignition is interrupted in response to relative movement of the end of the second cable with respect to the end of the first cable.

BRIEF DESCRIPTION OF THE DRAWINGS

The drawings illustrate the best mode presently contemplated of carrying out the invention.

DETAILED DESCRIPTION

Figure 1:
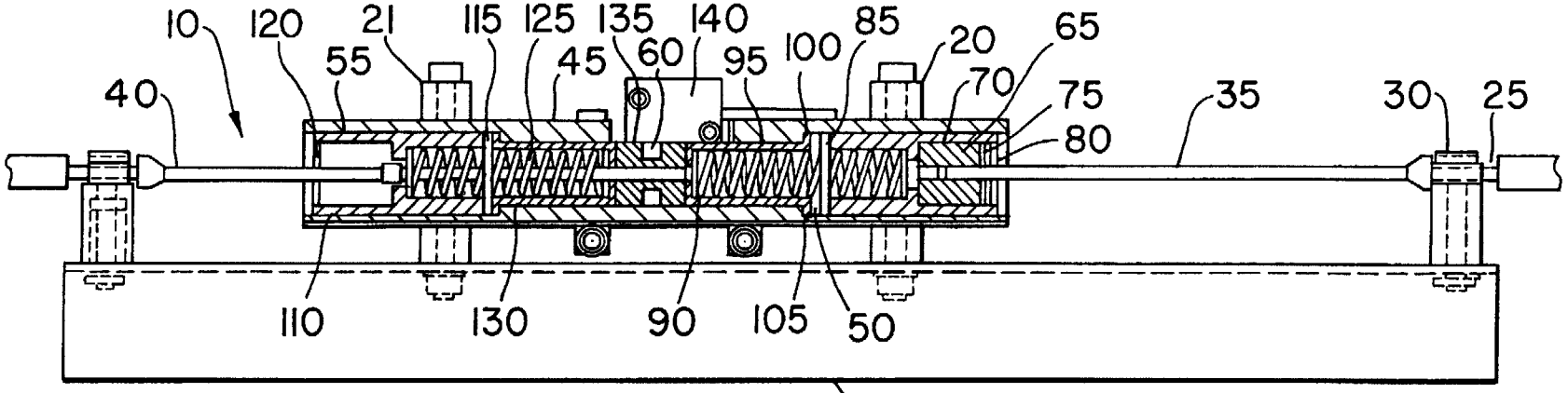
FIG. 1 is a side section view of the shift assist apparatus, showing the details of construction and operation.

In accordance with a preferred embodiment of the present invention, a spring or springs with a known response to force are provided, and when the predetermined force level is exceeded a deflection occurs, coaxial with the cables. A sensor detects this deflection and actuates an engine interrupt switch connected to the engine ignition circuit, preventing ignition in one or more cylinders of the engine. Throughout the operation of the device, the cable continues to function as a unitary cable.

The apparatus of the present invention includes first and second cables, an annular tube or sleeve operatively connecting the two cables, and one or more springs as means for maintaining the second cable within the tube. In one embodiment, the first cable is attached to a remote control station at which the marine drive operator shifts the transmission. The second cable is operatively connected to a transmission clutch, preferably a cone clutch, of the marine drive. At its end remote from the control station, the first cable is rigidly affixed to one end of the tube. A pair of cylindrical springs are held in compression within the tube by retainer tubes or rings, or other conventional means.

The second cable passes into the tube through the end opposite the first cable, through the retaining ring and the annulus of one of the cylindrical springs. It is held in position within the tube between the two cylindrical springs, preferably by a small sleeve on its end, sized to fit slidably within the bore of the tube. Otherwise, however, the transmission cable moves freely relative to the tube by sliding axially along the bore. Although at rest there may be a small gap between the sleeve of the transmission cable and the springs, the position of the transmission cable sleeve between the springs within the tube allows the entire device to function simply as a unitary cable at all times.

When excessive shift forces develop within the cable, the end sleeve of the transmission cable will move against the bias of the springs from its rest position. An engine interrupt sensor mounted on the outside of the tube, detecting this movement, interrupts the engine ignition circuit for one or more cylinders of the engine and prevents them from firing. This reduces the torque on the shift mechanism in the marine drive, thereby reducing the shift forces in the transmission cable and enabling the operator to shift the transmission. When the shifting operation is complete, the engine will resume normal firing.

Although the invention has been described with the remote control cable rigidly affixed to the tube, and the transmission cable held in biased position inside the tube, it will be readily clear to those of skill in the art that the position of the cables with respect to the tube and springs could be reversed without loss or compromise to the function of the device. Other features and advantages of the invention will be apparent to those skilled in the art upon reviewing the following detailed description, the drawings, and the claims.

Figure 2:
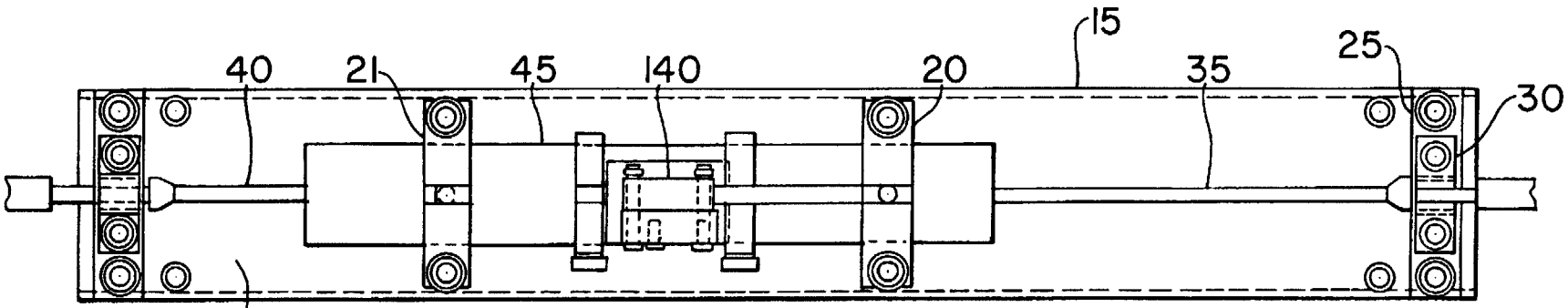
FIG. 2 is a top plan view of the apparatus.

Referring now to FIGS. 1 and 2, the shift assist unit and its operation will be described in detail. The shift assist unit, generally designated as 10, is preferably attached to a support member 15 which can be mounted at a convenient location in the marine drive unit or in the marine craft itself. Play within the system will be minimized, and responsiveness enhanced, by shorter cable lengths. Accordingly, the unit is preferably mounted within ten feet of the marine drive. The shift apparatus 10 is also preferably slidingly maintained on support member 15 by brackets 20 and 21.

A retainer 25 and bracket 30 are provided to retain the sheath (not shown) of the remote control cable core 35. A similar retainer and bracket (not numbered) are likewise provided for the transmission cable core 40. Each cable is conventionally comprised of a sheath and a core. However, the sheath is rigidly attached to the retainer and bracket; it is the core which is connected to the shift assist apparatus. Accordingly, reference to the cable core hereinafter will be simply to the "remote control cable 35" or the "transmission cable 40" as the case may be.

Figure 3:
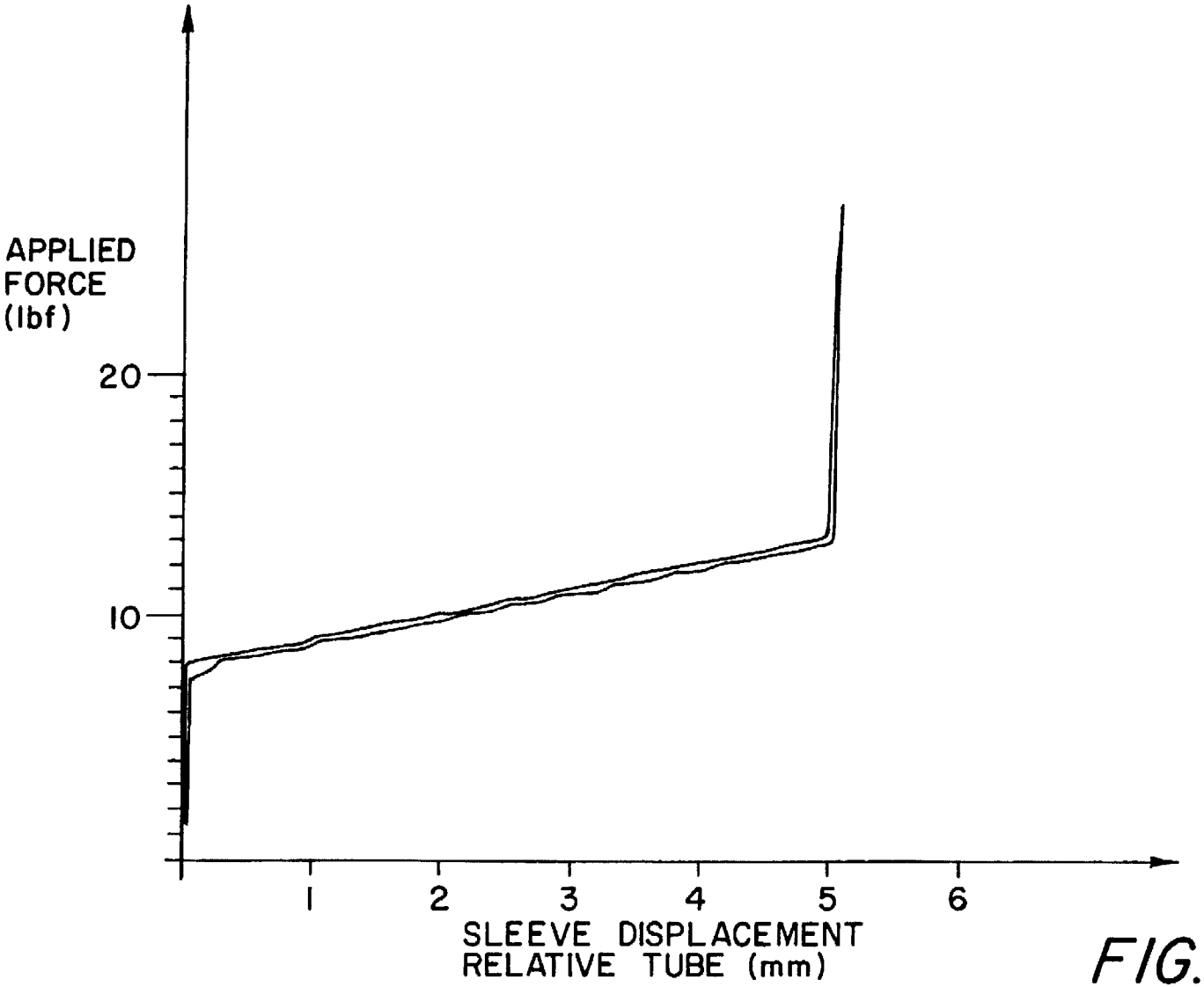
FIG. 3 is a graph illustrating deflection of a spring as a function of force applied thereto.

Shift interrupter 10 comprises a tube 45 slidingly maintained in brackets 20 and 21. The tube 45 is comprised of larger bore portions 50 and 55 near its outer ends and a smaller bore portion 60 in its interior. The remote control cable 35 is secured to the tube 45 by a sleeve 65, fixedly held within a retainer tube 70 by a retaining ring 75. The retainer tube 70 is held fixedly in the tube 45 by retaining rings 80 and 85. Spring 90 is provided with a spring sleeve 95. The spring 90 abuts the inside annular surfaces of the retainer tube 70 and the spring sleeve 95, passing through an aperture in the retaining ring 85. The spring 90 is maintained under a desired pre-stress compression force, associated with high transmission cable shift forces. In a preferred embodiment, a pre-stress force of 8 pounds force has been effectively employed as shown in FIG. 3. The spring sleeve 95 fits slidingly within the smaller bore portion 60 of the tube 45. A flange portion 100 of the spring sleeve 95 abuts ledge 105 separating outer bore 50 and the inner bore 60 of the tube 45.

A similar structure is provided on the other side of the tube 45. A retainer tube 110 is held fixedly in the large bore portion 55 of tube 45 by retaining rings 115 and 120. A spring 125 is provided with a spring sleeve 130. The spring 125 abuts against the inside annular surfaces of the retainer tube 110 and the spring sleeve 130, passing through an aperture in the retaining ring 115. The spring 125 is maintained under a pre-stress compression force equal to that of the other spring 90. The spring sleeve 130 fits slidingly within the smaller bore portion 60 of the tube 45. A flange portion (not numbered) is provided, similar to the flange portion 100 provided for the other spring sleeve 95. This flange portion abuts a ledge (not numbered) separating the outer bore 55 of the tube and the inner bore 60.

Unlike remote control cable 35, the transmission cable 40 is not rigidly attached to the tube 45. Instead, it passes into the smaller bore portion 60 of the tube 45 through the retainer tube 110, the annulus of the spring 125, and apertures in retaining rings 120 and 115 and the spring sleeve 130. The end of the transmission cable 40 is fitted with a notched sleeve 135 by conventional means. Although a notched sleeve is shown, other types of cable ends may be used, such as a ridged sleeve. So long as the cable end is capable of slidable movement in the smaller bore portion 60 of the tube 45, any arrangement may be used without departing from the scope of the invention.

The notched sleeve 135 is held in position between the spring sleeves 95 and 130. It is desirable to maintain a minimal amount of clearance between the notched sleeve 135 and the spring sleeves 95 and 130, to keep the amount of play in the cable system to a minimum. However, there may be a small gap between the ends of the spring sleeves 95 and 130 and the notched sleeve 135 when the system is at rest due to unavailable play in the system and because of machine tolerances. This will ordinarily not affect the operation of the shift assist device 10. The notched sleeve 135 may be made of any material that permits detection of its motion. Stainless steel, for instance, may be used in conjunction with an inductive proximity sensor.

In operation, the springs 90 and 125 resist deflection until a force equal to the desired pre-stress compression force is reached in the transmission cable 40. The notched sleeve 135 will be at rest between the spring sleeves 95 and 130.

When the desired pre-stress force in the transmission cable 40 is reached, the notched sleeve 135 will begin to compress either spring 90 or spring 125, depending upon the direction of the force. In so doing, the notched sleeve 135 will move relative to the tube 45. An inductive proximity sensor 140 is provided to detect this relative movement.

Spring characteristics are illustrated in FIG. 3, which shows the response characteristics for a preferred embodiment of the invention. FIG. 3 shows spring deflection on the horizontal axis and applied force on the vertical axis. Typically, the spring will remain under the desired pre-stress compression force until the force in the transmission cable exceeds the pre-stress force in the springs. As this occurs, the spring deflects. The maximum deflection is selected by the initial clearance between the flange of the spring sleeve and the retaining ring of the retainer tube. FIG. 3 illustrates an embodiment in which the clearance between, for example, spring sleeve flange 100 and retaining ring 85 is about 5 mm, as indicated by the vertical line at that deflection.

The range of deflection is preferably small, and values of about 3 mm to about 5 mm have been used. Smaller or larger ranges of deflection may be used without departing from the scope of the invention. At any point during the deflection, preferably around the midpoint, the switch is triggered and engine ignition is interrupted. Furthermore, it is desirable that maximum deflection be achieved within a relatively narrow force range. For the embodiment of FIG. 3, the spring will begin to deflect at approximately 8 pounds force. Full compression (5 mm deflection) occurs at approximately 13 pounds force. However, even smaller force ranges may be preferably used.

It will readily be apparent that many aspects of the invention may be varied without departing from the scope of the invention. For example, different pre-stress compression forces for the springs may be used, the choice depending upon such factors as the desired ease of shifting and the friction forces in the cable system. The scope of the invention is independent of the type of spring used. Stronger or weaker springs may be used, although it is believed that a spring functioning as illustrated in FIG. 3 would work satisfactorily for most marine drives.

A variety of motion sensors may be satisfactorily used, such as the mechanical switch sensor arrangement disclosed in U.S. Pat. Nos. 4,262,622 to Dretzka et al., 4,432,734 to Bland et al., and 4,753,618 to Entringer et al., the disclosures of which are hereby incorporated by reference. In the preferred embodiment of the present invention, an inductive proximity sensor 140 is employed. Many inductive proximity sensors are readily available, such as Honeywell inductive proximity sensor No. 922FS2-B4N-V3-Z895, which has been used satisfactorily. Other kinds of motion detectors may, of course, be used.

The inductive proximity sensor 140 will detect the movement of the notched sleeve 135, and send an electrical signal to interrupt the engine ignition circuit (not shown), thereby preventing the firing of one or more cylinders of the engine. It is preferred that two cylinders be prevented from firing, and that the ignition circuit alternate the cylinders interrupted among all the cylinders in the engine. The interruption of the engine ignition reduces the torque on the shift mechanism, in turn reducing the shift forces in the transmission cable 40 and enabling the operator to shift the transmission. When the shift operation is completed, the shift forces disappear, and the engine will resume normal firing. Interruption of an engine ignition circuit is known as a method of assisting shifting, as disclosed in U.S. Pat. No. 4,403,970 to Dretzka et al., the disclosure of which is hereby incorporated by reference.

The reduced number of moving parts will enable the marine drive to achieve longer periods of time between servicing needs for the shift interrupter over prior art devices. Should the device fail or stall, however, the engine ignition circuit is interlocked to resume full ignition of all cylinders after a finite time period, preferably about 3.0 to 3.5 seconds. This safety feature is provided to allow the engine to continue to function despite the failure of the device. In this case, the engine will continue to function. However, the ease of shifting made possible by the operation of the shift assist device will of course cease until the problem is corrected and the operation of the device restored.

It is to be understood that the foregoing is a description of a preferred embodiment of the invention and that various changes and modifications may be made without departing from the scope of the invention, as defined by the appended claims.

What is claimed is:

1. A shift assist device for assisting the shifting of a clutch of a marine drive or gear box by reducing the speed of said marine drive or gear box, said shift assist device comprising:

a first cable operatively connected to an operator station, said first cable having an end remote from said operator station;

a second cable coaxial with the first cable, operatively connected to a clutch mechanism and having an end remote from said clutch mechanism, capable of movement in common with said remote end of the first cable and relative to said remote end of the first cable;

a biasing means responsive to forces exceeding a threshold level for maintaining said end of the second cable in operative contact with said end of the first cable; and means for interrupting engine ignition in response to coaxial movement of said end of the second cable with respect to said end of the first cable.

2. A shift assist device according to claim 1, wherein said end of the first cable comprises a tube within which and with respect to which said end of the second cable is held in operative contact.

3. A shift assist device according to claim 2, wherein the biasing means comprises a first spring and a second cylindrical spring having an annulus, the second cable passing coaxially through said annulus, and said end of the second cable being positioned between said second cylindrical spring and said first spring.

4. A shift assist device according to claim 3, wherein the first spring and the second cylindrical spring are maintained under compression.

5. A shift assist device according to claim 4, wherein said means for interrupting engine ignition comprises a switch means responsive to said movement within the tube of said end of the second cable.

6. A shift assist device according to claim 5, wherein said switch means comprises an inductive proximity sensor.

7. A shift assist device for assisting the shifting of a clutch of a marine drive or gear box by reducing the speed of said marine drive or gear box, said shift assist device comprising:

a first cable operatively connected to an operator station, said first cable having an end remote from said operator station;

a second cable operatively connected to a clutch mechanism and having an end remote from said clutch mechanism and capable of movement in common with said end of the first cable and relative to said end of the first cable;

a spring responsive to forces exceeding a threshold level for maintaining said end of the second cable in operative contact with said end of the first cable; and means for interrupting engine ignition in response to relative movement of said end of the second cable with respect to said end of the first cable.

8. A shift assist device according to claim 7, wherein said end of the first cable comprises a tube within which and with respect to which said end of the second cable is held in operative contact.

9. A shift assist device according to claim 8, wherein the spring comprises a first spring and a second cylindrical spring having an annulus, the second cable passing coaxially through said annulus, and said end of the second cable being positioned between said second cylindrical spring and said first spring for movement within the tube in response to said forces exceeding a threshold level.

10. A shift assist device according to claim 9, wherein the first spring and the second cylindrical spring are maintained under compression.

11. A shift assist device according to claim 10, wherein said means for interrupting engine ignition comprises a switch means responsive to said movement within the tube of said end of the second cable.

12. A shift assist device according to claim 11, wherein said switch means comprises an inductive proximity sensor.

13. A shift assist device for assisting the shifting of a clutch of a marine drive or gear box by reducing the speed of said marine drive or gear box, said shift interrupter comprising:

a first cable operatively connected to an operator station, said first cable having an end comprising a tube, remote from said operator station;

a second cable operatively connected to a clutch mechanism and having an end remote from said clutch, capable of movement in common with said tube and relative to said tube;

a spring, maintained in compression and located within said tube, responsive to forces exceeding a threshold level, for maintaining said end of the second cable in operative contact with said tube; and a switch, responsive to movement of said end of the second cable with respect to said tube, for interrupting ignition of the marine drive or gear box.

14. A shift assist device according to claim 13, wherein the spring comprises a first and a second cylindrical spring having an annulus, the second cable passing coaxially through said annulus of said second cylindrical spring, said end of the second cable being positioned between said second cylindrical spring and said first cylindrical spring for relative movement within the tube in response to said forces exceeding a threshold level.

* * * * *

UNITED STATES PATENT AND TRADEMARK OFFICE

CERTIFICATE OF CORRECTION

PATENT NO : 5,692,992

DATED : December 2, 1997

INVENTOR(S): L. Arvidsson et al.

It is certified that error appears in the above-identified patent and that said Letters Patent is hereby corrected as shown below:

On the title page, item [73]

In the Assignee section, delete "Volva" and insert--Volvo--.

Signed and Sealed this

Fifth Day of May, 1998

Bruce Lehman

*Attest:*

BRUCE LEHMAN

*Attesting Officer*

*Commissioner of Patents and Trademarks*